US008317536B2

(12) United States Patent
Flojo

(10) Patent No.: US 8,317,536 B2
(45) Date of Patent: Nov. 27, 2012

(54) GROUND CLAMP WITH BALL CONTACT STUD

(75) Inventor: Alfred R. Flojo, Chicago, IL (US)

(73) Assignee: Honeywell International Inc., Morristown, NJ (US)

( * ) Notice: Subject to any disclaimer, the term of this patent is extended or adjusted under 35 U.S.C. 154(b) by 183 days.

(21) Appl. No.: 12/884,613

(22) Filed: Sep. 17, 2010

(65) Prior Publication Data

US 2011/0081810 A1 Apr. 7, 2011

Related U.S. Application Data

(60) Provisional application No. 61/248,579, filed on Oct. 5, 2009.

(51) Int. Cl.
*H01R 13/00* (2006.01)

(52) U.S. Cl. ..... 439/477; 439/803

(58) Field of Classification Search ..... 439/477, 439/478, 479, 803
See application file for complete search history.

(56) References Cited

U.S. PATENT DOCUMENTS 5,556,299 A * 9/1996 Finke ..... 439/479
6,891,106 B2 * 5/2005 Sumner ..... 174/78
7,160,142 B2 * 1/2007 Hughes et al. ..... 439/479
7,485,014 B2 * 2/2009 De France ..... 439/803
7,614,923 B2 * 11/2009 De France ..... 439/803
2004/0182593 A1 * 9/2004 Sumner ..... 174/87
2008/0026613 A1 * 1/2008 De France ..... 439/100
2009/0103974 A1 * 4/2009 Dendis et al. ..... 403/135
2009/0130872 A1 * 5/2009 De France ..... 439/100
2011/0081810 A1 * 4/2011 Flojo ..... 439/803

OTHER PUBLICATIONS

Hubbell Power Systems, Inc.; Personal Protective Equipment; Catalog; Copyright 2008; pp. 8-1 to 8-11; Section 8; Hubbell Incorporated; www.hubbellpowersystems.com; hpsliterature@hps.hubbell.com.

* cited by examiner

*Primary Examiner* — James Harvey

(74) *Attorney, Agent, or Firm* — Husch Blackwell LLP

(57) ABSTRACT

A grounding clamp carries a through-hole where one end of the hole or opening carries a multi-sided socket, such as a hex-shaped socket or depression. A pair of ball studs extend in part into the through-hole and threadably lock together trapping or sandwiching the clamp therebetween. One of the ball studs is blocked from rotating by the hex-shaped socket. As the other ball stud is rotated onto it, the three components, the clamp and the two ball studs form a composite grounding assembly which is locked together.

20 Claims, 5 Drawing Sheets

SECTION 3-3

SECTION 4-4

GROUND CLAMP WITH BALL CONTACT STUD

CROSS-REFERENCE TO RELATED APPLICATION

This application claims the benefit of the filing date of Oct. 5, 2009 of U.S. Provisional Application Ser. No. 61/248,579 entitled, "Ball Contact Stud Ground Clamp". The '579 application is hereby incorporated herein by reference.

FIELD

The invention pertains to ground clamps. More particularly, the invention pertains to such clamps as are used in the electrical utility industry as protective-grounding equipment.

BACKGROUND

Grounding assemblies including various forms of clamps, ferrules and interconnecting cables are often used as protective equipment for personnel working around electric power lines. C-type clamps are a known form of grounding clamp used for this purpose. One commercially available C-type clamp is available as a Salisbury 21074 2" grounding clamp.

Known C-type clamps often have provisions for the installation of metal ball studs. For example, a Salisbury No. 21192 externally threaded ball stud can be passed through a hole in a C-type clamp and threaded onto a Salisbury 24082 internally threaded ball stud.

Know attachments of ball studs to clamps often use a round hole, which might be treaded, in the clamp. Alternately, the ball studs can be permanently attached by welding to the respective clamp.

DETAILED DESCRIPTION

Figure 1B:
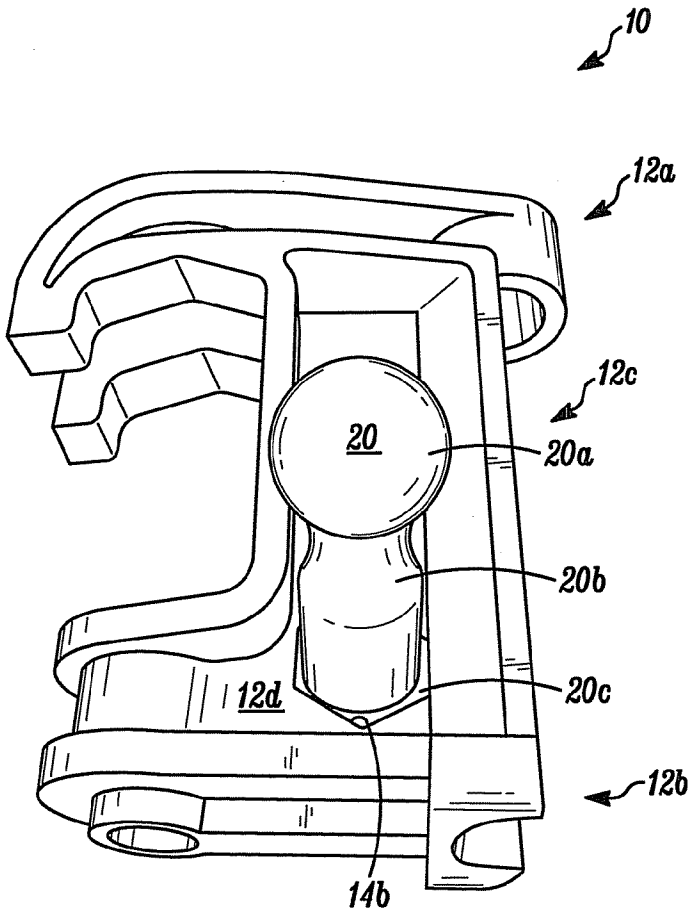
FIG. 1B is a view of a first side of the clamp of FIG. 1A with an attached, internally threaded ball stud.
Figure 1A:
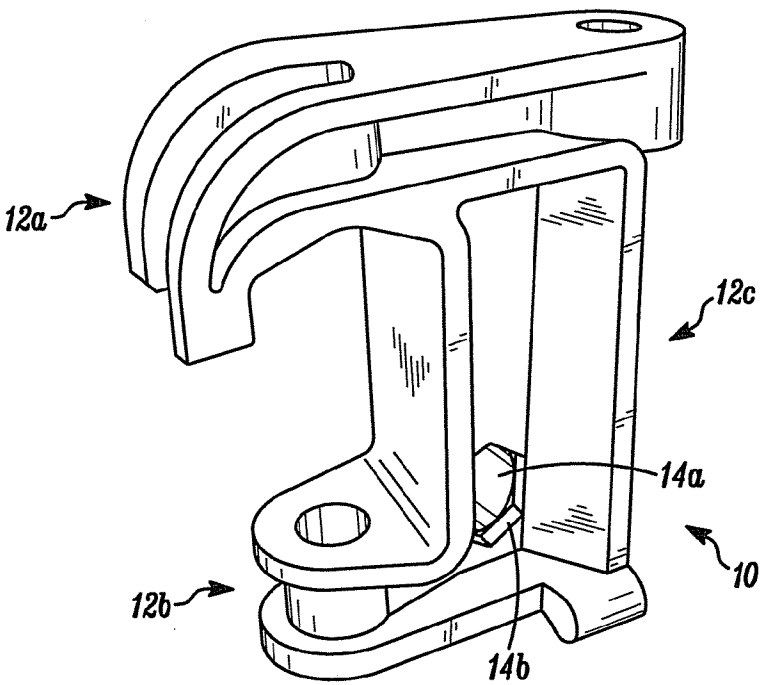
FIG. 1A is a perspective view of a C-type clamp in accordance with the invention.
Figure 1D:
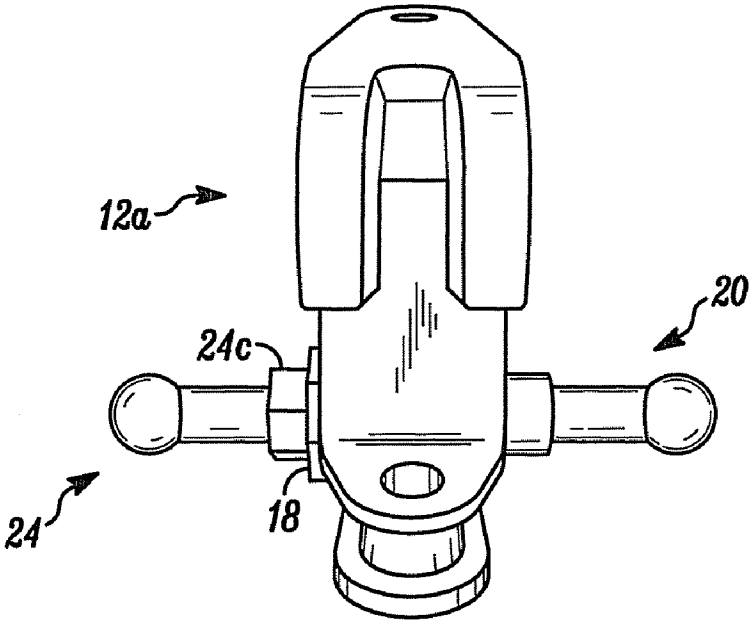
FIG. 1D is an end view of the clamp of FIG. 1A.
Figure 1C:
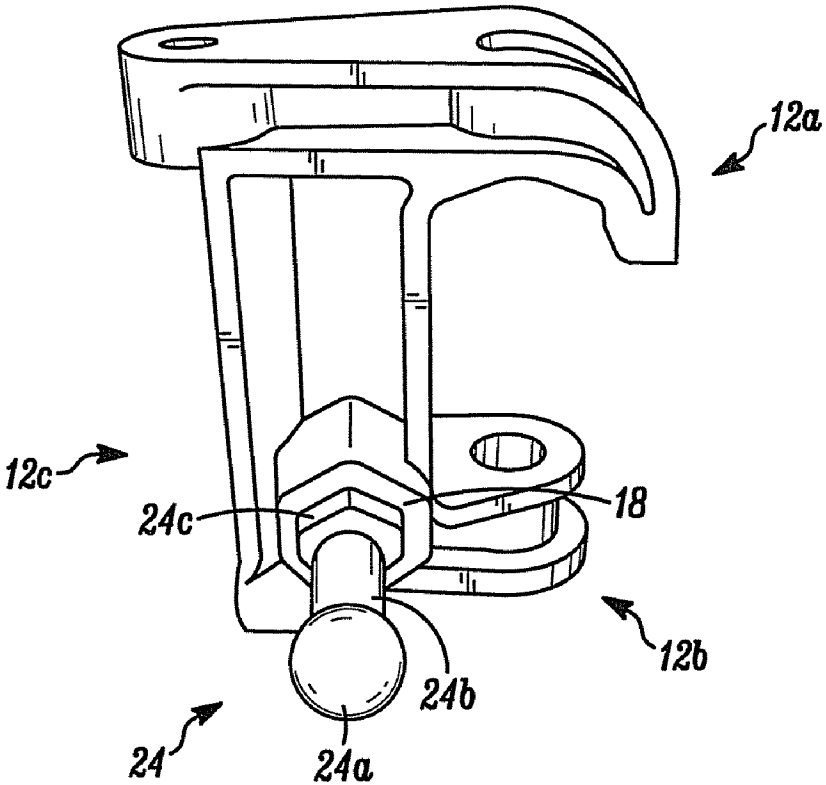
FIG. 1C is a view of a second side of the clamp of FIG. 1A with an attached externally threaded ball stud.
Figure 2A:
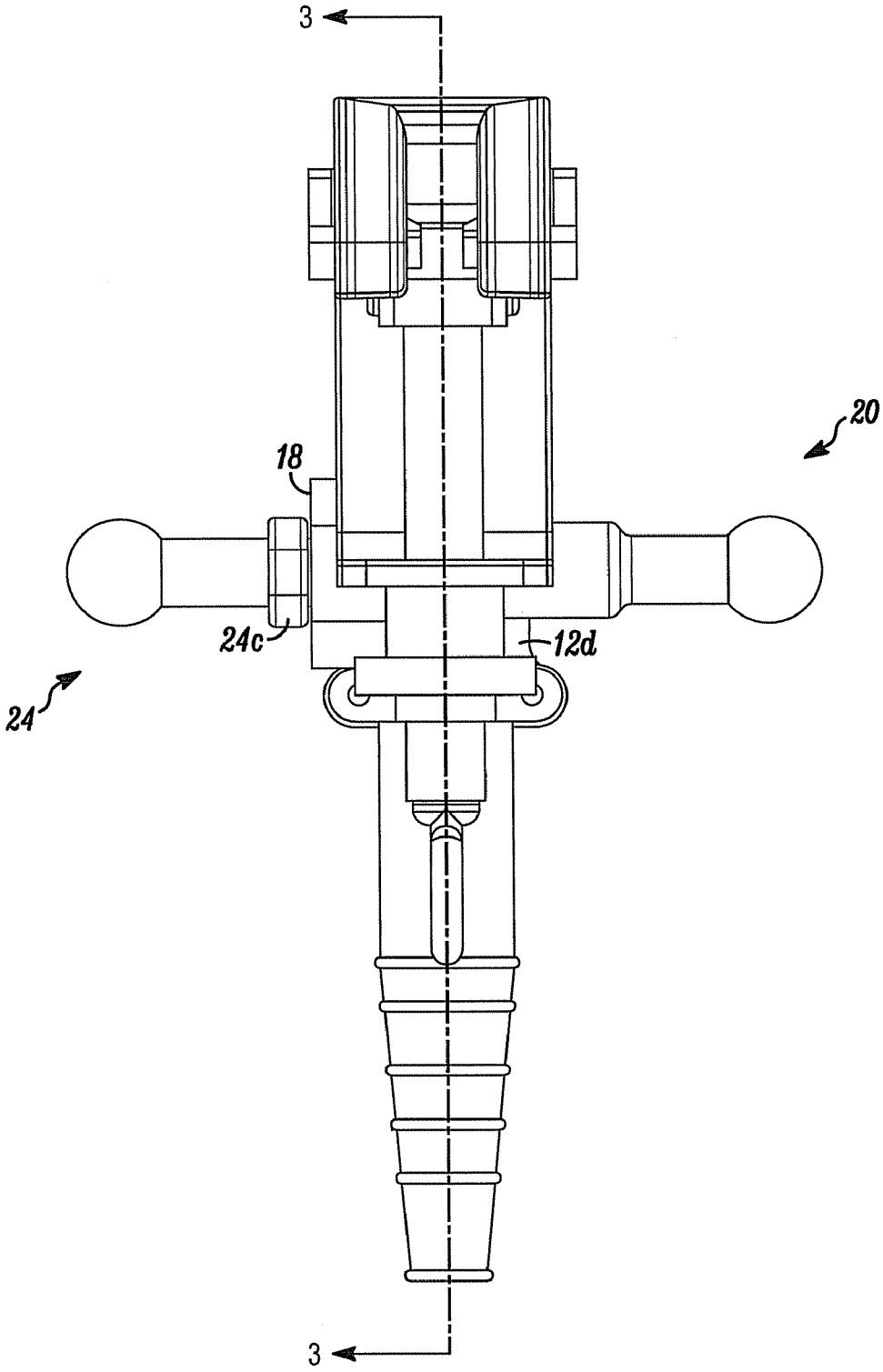
FIG. 2A is a front view of the C-type clamp of FIG. 1A.
Figure 2B:
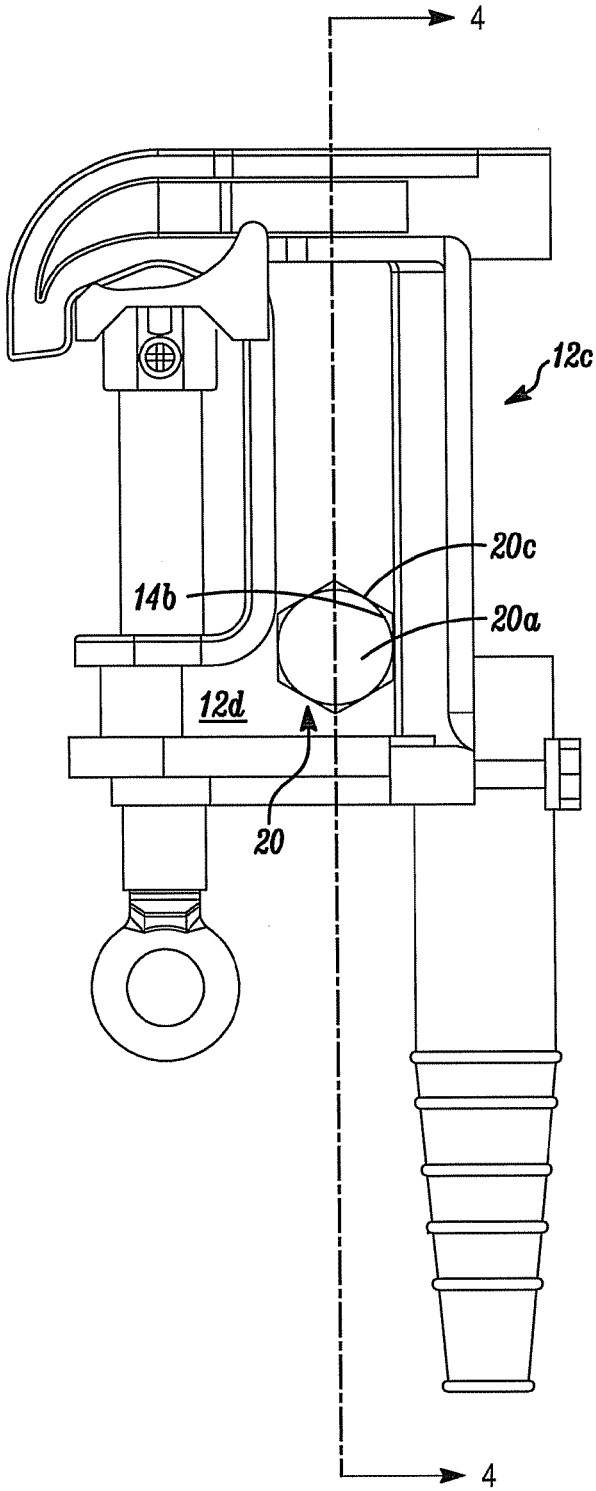
FIG. 2B is a side view of the clamp of FIG. 2A.
Figure 3:
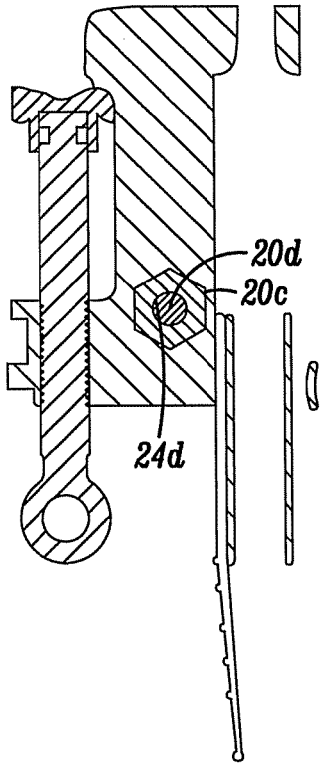
FIG. 3 is a half-sized, sectional view, along plane 3-3 of FIG. 2A.
Figure 4:
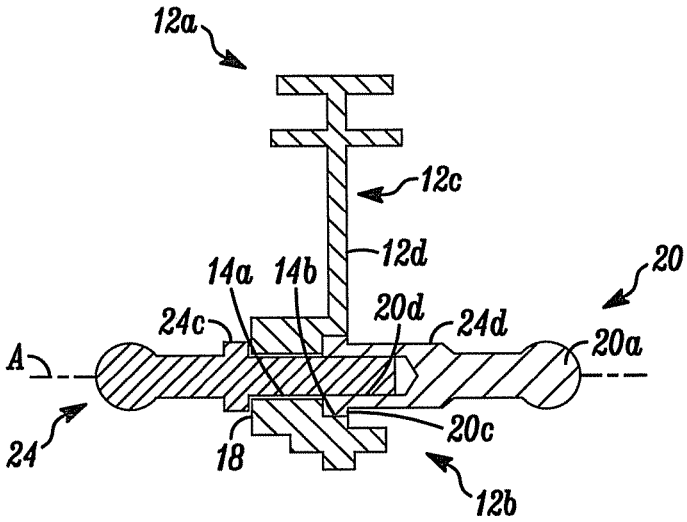
FIG. 4 is a half-sized, sectional view, along plane 4-4 of FIG. 2B.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

A clamp which embodies the invention has a metal ground clamp with a hexagonal pocket with a thru hole formed in the rear section of the body's flange. The pocket will receive the base section of an internal, female, metal ball stud. The opposite side will accept a male metal ball stud which can feed through the hold and thread into the internal ball stud.

The clamp enables the female ball stud to seat into the body of the clamp, and be non-rotatable relative to the clamp, and the male ball stud to feed through from the opposite side of the clamp. The male ball stud provides a mechanism to tighten the studs to the clamp.

In one embodiment, a Salisbury internal ball stud such as No. 24082 can threadably engage a Salisbury ball stud No. 21191. The figures illustrate various aspects of embodiments of the invention. Section 4-4 illustrates the internal treaded engagement of the internal ball stud and the male ball stud. Section 3-3 illustrates the hexagonal shape of a portion of the body of the female ball stud.

With respect to FIGS. 1-4, a C-type clamp 10 has first and second spaced apart body sections 12*a,b* joined by center section 12*c*. A through-hole 14*a* extends through the section 12*c*.

A multi-sided, hexagonal for example, socket or pocket 14*b* is formed in a region 12*d* of the center section 12*c*, best seen in FIG. 1B. The socket 14*b* does not extend entirely through central section 12*a* as does the through-hole 14*a*. Preferably both the through-hole 14*a* and the socket 14*b* have a common central axis, A, best see in FIG. 4.

First and second ball studs, 20, 24 are carried by clamp 10. The ball studs 20, 24 threadably engage one another. In the disclosed embodiment, ball stud 20 has an exterior spherical end 20*a*, a cylindrical stem 20*b* and a multi-sided hexagonal collar 20*c* which slidably engages the depression 14*b* with the mating shape. The ball stud 20 carries internal threads 20*d*.

The ball stud 24 carries external threads 24*d* which rotatably engage the internal threads 20*d* trapping or, sandwiching, the clamp 10 therebetween. The ball stud 24 carries an external collar 24*c* which slidably engages exterior surface 18 of the region 12*c* as the two studs 20, 24 are rotated toward one another. As the ball stud 24 is rotated toward stud 20, the frame portion 12*c* blocks rotation of the stud 20 due to the interaction between depression 14*b* and the exterior collar 20*c* thereby providing a locked together assembly of the clamp 10 and studs 20, 24.

Those of skill in the art will understand that neither the exact shape of the clamp, nor of the ball studs, nor threads, are limitations of the invention. It will be understood that other types of connections between the ball studs can come within the spirit and scope of the invention.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. An assembly comprising:

a clamp, the clamp has a perforation therethrough;

a first ball stud with an elongated stem where the stem terminates in a collar with an exterior surface that slidably and linearly engages a portion of the perforation; and a second ball stud that has a stem which extends, at least in part into the perforation and connects with the first ball stud.

2. An assembly as in claim 1 where the clamp has a C-shaped body.

3. An assembly as in claim 1 where the clamp has first and second generally parallel, spaced apart, metal sections joined by a third section extending therebetween with the perforation formed in the third section.

4. An assembly as in claim 3 where the ball studs extend generally perpendicular to the clamp.

5. An assembly as in claim 1 where the studs are connected together by first and second threads.

6. An assembly as in claim 5 where the studs are rotatably connected together by the threads.

7. An assembly as in claim 6 where as the studs are rotated relative to one another the clamp is sandwiched therebetween.

8. An assembly comprising:

a clamp, the clamp has a perforation therethrough;

a first ball stud with an elongated stem where the stem terminates in a collar with an exterior surface that slidably and linearly engages the clamp; and a second ball stud that has a stem which extends, at least in part into the perforation and connects with the first ball stud where the clamp includes a socket and the first ball stud slides linearly into the socket, and where the socket blocks rotation of the first ball stud relative to the clamp.

9. An assembly as in claim 8 where the second ball stud rotates onto the first ball stud.

10. An assembly as in claim 9 where the perforation and the socket have a common axis.

11. An assembly as in claim 4 where the clamp includes a socket and the first ball stud slides linearly into the socket, and where the socket blocks rotation of the first ball stud relative to the clamp.

12. An assembly as in claim 11 where the clamp is sandwiched between the connected ball studs.

13. An assembly as in claim 12 where the second ball stud rotates onto the first ball stud and where the socket blocks rotation of the first ball stud relative to the clamp.

14. An assembly as in claim 13 where the perforation is circular and where the socket and the perforation have a common central axis.

15. An assembly as in claim 1 where the first ball stud, when engaged with the clamp is blocked from rotation relative to the clamp.

16. A grounding assembly comprising:

a metal clamp with two spaced apart regions joined by a third, substantially linear region where the clamp has a perforation in the third region where the perforation has a central axis;

a screw-type jaw carried by the clamp that extends between and is movable linearly between the first and second regions; and a socket formed in the third region, extending partly thereinto on the central axis.

17. A grounding assembly as in claim 16 which includes a first metal ball stud with an elongated stem where the stem terminates in a collar with an exterior surface that slidably and linearly engages the socket; and a second metal ball stud that has a stem which extends, at least in part into the perforation and connects with the first ball stud.

18. A grounding assembly as in claim 17 where each of the ball studs carry threads, and where, they rotatably engage one another with a portion of the third region sandwiched therebetween.

19. A grounding assembly as in claim 18 which includes a metal clamping member movable between open and closed positions to attach the clamp to an electrical conductor.

20. An assembly as in claim 1 where the two ball studs threadably engage one another.

* * * * *